US011261620B2

(12) United States Patent
Pashkevych et al.

(10) Patent No.: US 11,261,620 B2
(45) Date of Patent: Mar. 1, 2022

(54) BLOCKING LOCK WITH MATRIX CODING SYSTEM

(71) Applicants: Leonid Polikarpovych Pashkevych, Kyiv (UA); Serhii Volodymyrovych Cherepov, Kyiv (UA)

(72) Inventors: Leonid Polikarpovych Pashkevych, Kyiv (UA); Serhii Volodymyrovych Cherepov, Kyiv (UA)

( * ) Notice: Subject to any disclaimer, the term of this patent is extended or adjusted under 35 U.S.C. 154(b) by 146 days.

(21) Appl. No.: 16/607,856

(22) PCT Filed: Dec. 1, 2017

(86) PCT No.: PCT/UA2017/000116
§ 371 (c)(1),
(2) Date: Oct. 24, 2019

(87) PCT Pub. No.: WO2018/199872
PCT Pub. Date: Nov. 1, 2018

(65) Prior Publication Data

US 2020/0190853 A1 Jun. 18, 2020

(30) Foreign Application Priority Data

Apr. 28, 2017 (UA) ..... a 2017 04250

(51) Int. Cl.
*E05B 35/00* (2006.01)
*E05B 27/10* (2006.01)
*E05B 27/08* (2006.01)

(52) U.S. Cl.
CPC ..... *E05B 35/007* (2013.01); *E05B 27/08* (2013.01); *E05B 27/10* (2021.08)

(58) Field of Classification Search
CPC ..... E05B 27/02; E05B 27/08; E05B 35/007; E05B 35/008; E05B 27/10; E05B 35/002
See application file for complete search history.

(56) References Cited

U.S. PATENT DOCUMENTS

| | | | | |
|---|---|---|---|---|
| 3,780,548 A | | 12/1973 | Anastasov | |
| 4,149,394 A | | 4/1979 | Sornes | |
| 4,452,059 A | * | 6/1984 | Sornes | E05B 27/0028 70/278.2 |
| 4,461,161 A | * | 7/1984 | Shpigelman | E05B 35/007 40/385 |
| 5,025,647 A | | 6/1991 | Muus | |
| 5,086,632 A | | 2/1992 | Hsu | |
| 5,131,247 A | * | 7/1992 | Hsu | E05B 19/18 70/358 |
| 5,181,407 A | * | 1/1993 | Wu | E05B 35/007 70/276 |

(Continued)

FOREIGN PATENT DOCUMENTS

| | | |
|---|---|---|
| EP | 0066558 | 12/1982 |
| EP | 1863048 | 12/2007 |

(Continued)

*Primary Examiner* — Christopher J Boswell
(74) *Attorney, Agent, or Firm* — Defillo & Associates, Inc; Evelyn A. Defillio

(57) ABSTRACT

The invention relates to locking devices of enhanced security. primarily locks for locking dead bolt systems of safes, metal doors of residential buildings, public and other buildings and offices, as well as to padlocks, etc., where a high level of resistance to breaking is required.

3 Claims, 3 Drawing Sheets

(56) References Cited

U.S. PATENT DOCUMENTS

| | | | | | |
|---|---|---|---|---|---|
| 5,291,766 | A * | 3/1994 | Eisermann | E05B 47/0043 | 70/276 |
| 5,355,701 | A * | 10/1994 | Tobias | E05B 19/205 | 70/394 |
| 5,669,254 | A * | 9/1997 | Lee | E05B 35/007 | 70/377 |
| 6,666,057 | B1 * | 12/2003 | Huang | E05B 35/002 | 70/375 |
| 7,131,301 | B1 * | 11/2006 | Chang | E05B 35/007 | 70/134 |
| 2006/0156771 | A1 | 7/2006 | Hauri | | |
| 2019/0264480 | A1 * | 8/2019 | Rankin, Sr. | E05B 63/18 | |

FOREIGN PATENT DOCUMENTS

| | | |
|---|---|---|
| RU | 2015279 | 6/1994 |
| RU | 2078891 | 5/1997 |
| SU | 738522 | 5/1980 |
| UA | 13914 | 4/1997 |

* cited by examiner

BLOCKING LOCK WITH MATRIX CODING SYSTEM

CROSS REFERENCE TO RELATED APPLICATION

This application is a national stage entry of PCT/UA2017/000116 filed Dec. 1, 2017, under the International Convention and claiming priority over Ukraine Patent Application No. a 2017 04250 filed Apr. 28, 2017.

FIELD OF THE INVENTION

The invention relates to locking devices of enhanced security, primarily locks for locking crossbar (deadbolt) systems of safes, metal doors of residential buildings, public and other buildings and offices, as well as to padlocks, etc., where a high level of resistance to breaking is required.

BACKGROUND OF THE INVENTION

An exemplary high security blocking lock includes a housing wherein there is arranged a mechanism providing for a deadbolt movement and a code mechanism most often of the lever tumbler type locking this movement. Also, in the housing, there is a slot for entering a key, which, when rotating, interacts with a set of lever tumblers moving them so that the deadbolt unlocks, and further it shifts the dead bolt with opening the lock.

It is known that those blocking locks can be opened while manipulating the lock mechanism through a key slot. As a result of such actions, one can use a special tool (master key) to arrange a set of lever tumblers into a position wherein the blocking lock can be unlocked. The basic principle of providing action against unlocking with the help of master key is to reduce effective size of key slot, which event can significantly complicate the process of manipulating a master key in a lock mechanism through a key slot.

The most promising way to solve the problem is to use a key punched card, which can significantly reduce a size and width of a key slot.

There are known locking devices comprising a key made in the form of a plate with openings wherein the key code information is read by the way of inserting balls placed above the locking pins (PINs) arranged in accordance with the lock code [GB No. 2094386 A, EV05B 27/10, 1982; U.S. Pat. No. 5,025,647, EV 05/21, 1991; U.S. Pat. No. 4,149,394, EV 71/00, 1978; SU No. 738522 A3, E05B 27/08. 1977].

In the known devices, the keys provide the displacement of the locking pins (PINs) with the help of balls, and in this regard, the keys should be made of rather great thicknesses, which fact significantly reduces the protective properties of the locks.

A punched card-controlled device is also known for a blocking lock of a locking, signaling or similar type comprising a supporting block with a movable retractable element inserted into a box-shaped portion of the frame and displaced along the guide blocks. The movable retractable element has a central slot into which a punched card-controlled key is inserted to unlock the lock. On the opposite side of the central slot, the movable element and the supporting block are provided with some coaxial openings. Into several openings, there are resiliently inserted pins arranged against each other. While a punched card-key being inserted into the slot, the pins are disposing so that their adjacent surfaces tend to be located in the plane of the surface of the movable retractable element. As a result, the latter is released and can be shifted in the block [EPO No. 0066558, E05B 27/00, 1982].

The disadvantage of this device is the lack of secrecy due to the thick key, which event allows probing the lock code.

Also, there are known devices with a thin plate-like key (U.S. Pat. No. 3,780,548, E05b 21/00, 1973; RU No. 2015279 C1, E05B 27/08, 1994). The disadvantage of such devices is their design complexities, which fact can cause the failure of individual elements and makes them insufficiently reliable.

There is known a code device for a lock, comprising a housing having a transverse opening wherein locking pins are located, a longitudinal slot for a lock wherein code openings are formed, and a movable locking plate located in the housing and having transverse blind holes with spring-loaded pins arranged therein, FRG application No. 1952612, E 05b 27/08, 1973].

The closest to the claimed invention is a code device for a lock, comprising a housing having transverse openings wherein locking pins are located, a longitudinal slot for a plate-like key with code openings, and a movably locking plate arranged in the housing and provided with transverse blind holes wherein spring-loaded pins are arranged to be in contact with the locking pins; above the locking pins, there are disposed balls overlapping the key slot, and in the housing, there are formed blind holes for balls having depths that are not greater than the radii of the balls [UA No 13914 A, E05B 27/00, 1997].

The disadvantages of the prototype include the complexity of the industrial manufacture of the lock with such a code device due to the need to form a long and narrow longitudinal slot for a plate-like key in the monolithic housing, the complexity of the procedure for coding the lock with such a device due to the presence of the transverse blind holes for the spring-loaded pins in the movable locking plate. In this case, it is necessary to have a mechanism for moving the locking plate, which event would further complicate the design of the lock. Also, it might be possible to jam the coding pins when inserting a key with openings in case of accidental displacement of the locking plate. A lock with such a code mechanism has insufficient protection against manipulation through the key entry slit.

SUMMARY OF THE INVENTION

The basis of the invention is a technical problem to create a code lock, which should have an enhanced anti-burglary function, an easy lock coding system that would be available to automated production, a system for preventing jamming of coding pins when entering a key into the lock.

The problem is solved by the fact that in the a blocking lock with a matrix coding system comprising a housing containing a slot for a plate-like key, a movable locking plate, pins, balls overlapping the slot for the plate-like key, and openings for the balls, those openings depths being not greater than the balls radii, according to the claimed invention, a key mortise plate is rigidly fastened to the movable locking plate; and in the housing, there is a stationary matrix provided with openings for code elements, those openings being drilled in the matrix coaxially with the locking plate in its maximum locked position, and having balls, short and long pins, and code springs disposed therein; in the housing, there is formed a rotating protrusion for guiding the key to a region of the key mortise plate having a recess for the balls, and being further provided with a working spring to interact with the housing and the locking plate; the locking plate and the matrix are provided with openings of a synchronization system designed for synchronizing operation of the blocking lock, which system also comprises a locking ball, a push pin, and a spring of the synchronization system, the housing has a cover to fix the matrix and compress the code springs and also the synchronization system spring.

The housing is provided with a narrow slot for a thin plate-like key of a curved shape formed by the radii of the rotating protrusion, the locking plate and the matrix. The thin plate-like key is formed to be bent at an angle of up to 90 degrees from its initial direction of movement when inserted into the blocking lock.

In the housing of the blocking lock, outside the perimeter of the rotating protrusion, there is formed a groove to loosen the housing in the area of the rotating protrusion.

The blocking lock of the claimed invention has an improved design intended for industrial production. It needs no additional mechanisms for moving the locking plate (dead bolt), is provided with an enhanced protection against manipulating the lock code through the key slit, with an easy operating lock coding system, which is available to automated production, and also with a system for preventing jamming of the coding pins when inserting the key into the lock.

The blocking lock has an enhanced anti-burglary function due to the fact that when inserted into the blocking lock, a thin plate-like key bends at an angle of up to 90 degrees from the original direction of its movement, passes the key code control zone and, when being further inserted into the lock until it stops in the locking plate (dead bolt), it unlocks the code mechanism and the synchronization system and also shifts the locking plate (dead bolt).

BRIEF DESCRIPTION OF THE FIGURES

The invention is illustrated by drawings.

DETAILED DESCRIPTION OF THE INVENTION

Figure 1:
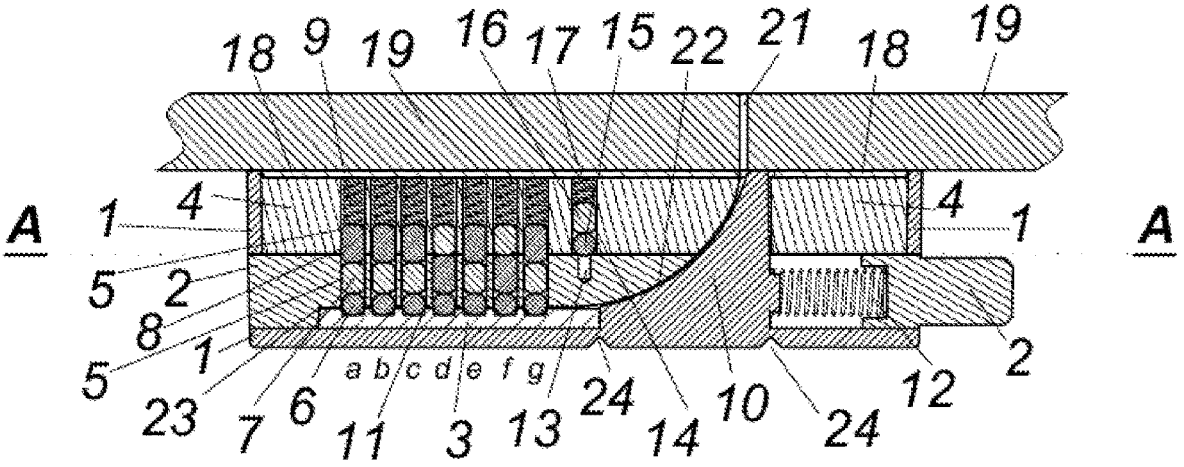
FIG. 1 shows a section of the blocking lock in a locked state.

The blocking lock (FIG. 1) consists of housing 1, which comprises movable locking plate (dead bolt) 2 with key mortise plate 3 fixed thereon and stationary matrix 4. In matrix 4, coaxially with locking plate 2 in its maximum (locked) position, there are drilled openings 5 for the code elements, in which openings balls 6, short 7 and long 8 pins (PINs), and code springs 9 are located. Housing 1 also has rotating protrusion 10 for directing the key to the area of key mortise plate 3. In turn, key mortise plate 3 has recess 11 for balls 6 each of a depth less than the radius of ball 6. The blocking lock also comprises working spring 12 interacting with housing 1 and locking plate 2 and bringing the locking plate to the state of the 'locked' position, wherein key mortise plate 3 abuts against rotating protrusion 10 or other locking stop (not shown). In this position, the axes of openings 5 in locking plate 2 and matrix 4 coincide. Also in locking plate 2 and matrix 4, there are formed openings 13 and 14 of the blocking lock synchronization system, which also includes locking ball 15, pin 16 and spring 17 of the synchronization system. In the blocking lock state of the 'locked' position, the axes of openings 13 and 14 coincide. Housing 1 is closed by cover 18 fixing matrix 4 in housing 1 and compressing code springs 9 and spring 17 of the synchronization system.

Figure 5:
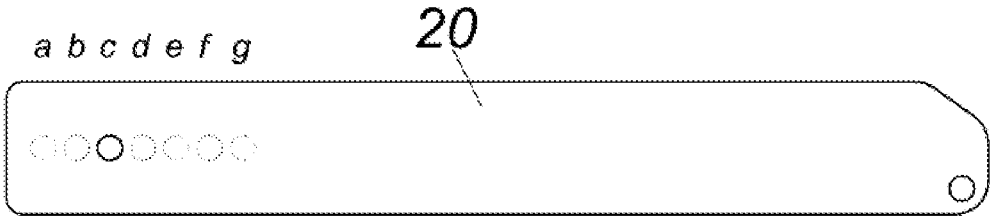
FIG. 5 shows the appearance of the key with the wrong code.
Figure 6:
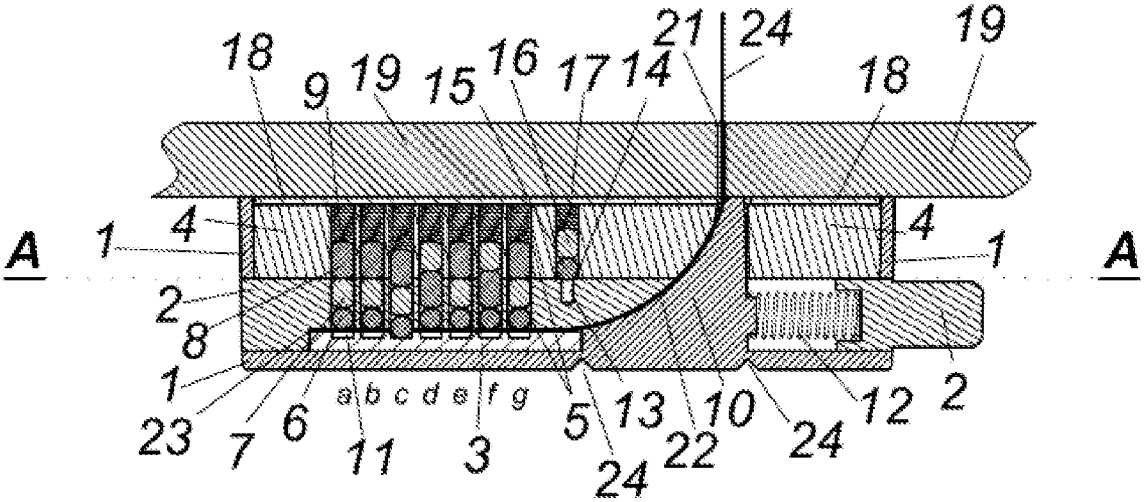
FIG. 6 shows the blocking lock in the locked state when inserting the key with the wrong code.

The blocking lock is arbitrarily fixed on door 19 of safe or premise. Key 20 with the correct code (FIG. 2) or incorrect code (FIG. 5) can be inserted into narrow slot 22 for a thin plate-like key through narrow key slit 21 in door 19 and a matching key slit in cover 18. Narrow slot 22 for the thin plate-like key has a curved shape created by the radii of rotating protrusion 10 of locking plate 2 and matrix 4. Along slot 22, key 20 can be bent at an angle of up to 90 degrees from the original direction of the movement and inserted into the key code control zone (balls 5 in recesses 11 being at the positions of "a" to "g" of key mortise plate 3) up to stop 23 in locking plate 2. On the outside of housing 1 along the perimeter of rotating protrusion 10, there is formed weakening groove 24 to counteract breaking the blocking lock by taking it down from the fixtures of door 19 through key slit 21.

The blocking lock operates as follows.

The initial state of the blocking lock is the state of the 'locked' position shown in FIG. 1. Let the code of the blocking lock in this case be the digital number of 0001010 in the binary system that corresponds to the following arrangements of the code pins:

In "a" position, on ball 6, there is short pin 7, on it, there is long pin 8 pressed from above by code spring 9;

In "b" position, on ball 6, there is short pin 7, on it, there is long pin 8 pressed from above by code spring 9—position "0";

In "c" position, on ball 6, there is short pin 7, on it, there is long pin 8 pressed from above by code spring 9—position "0";

In "d" position, on ball 6, there is long pin 8, on it, there is short pin 7 pressed from above by code spring 9—position "1";

In "e" position, on ball 6, there is short pin 7, on it, there is long pin 8 pressed from above by code spring 9—position "0";

In "f" position, on ball 6, there is long pin 8, on it, there is short pin 7 pressed from above by code spring 9—position "1";

In "g" position, on ball 6, there is short pin 7, on it, there is long pin 8 pressed from above by code spring 9—position "0".

Figure 2:
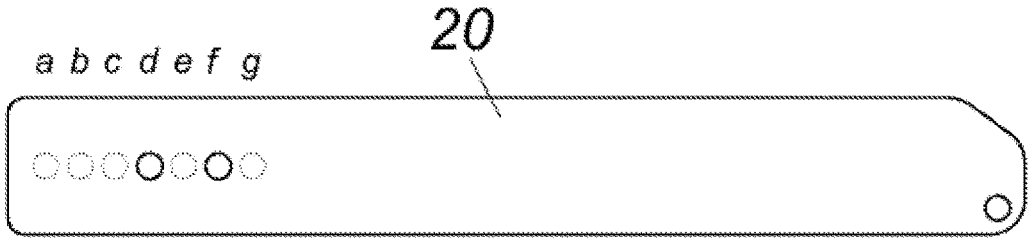
FIG. 2 shows the appearance of the key with the correct code.

This code corresponds to the presence of the openings in the positions of "d" and "f" and the absence of the openings in the positions of "a", "b", "c", "e" and "g" on key 20 (FIG. 2). In this case, in the absence of key 20 with the correct code in the blocking lock, it is in the locked state, that is, the movement of locking plate 2 is locked by long pins 8 in the positions of "a", "b", "c", "e" and "g", which partially enter locking plate 2 and fix it relative to matrix 4.

Figure 3:
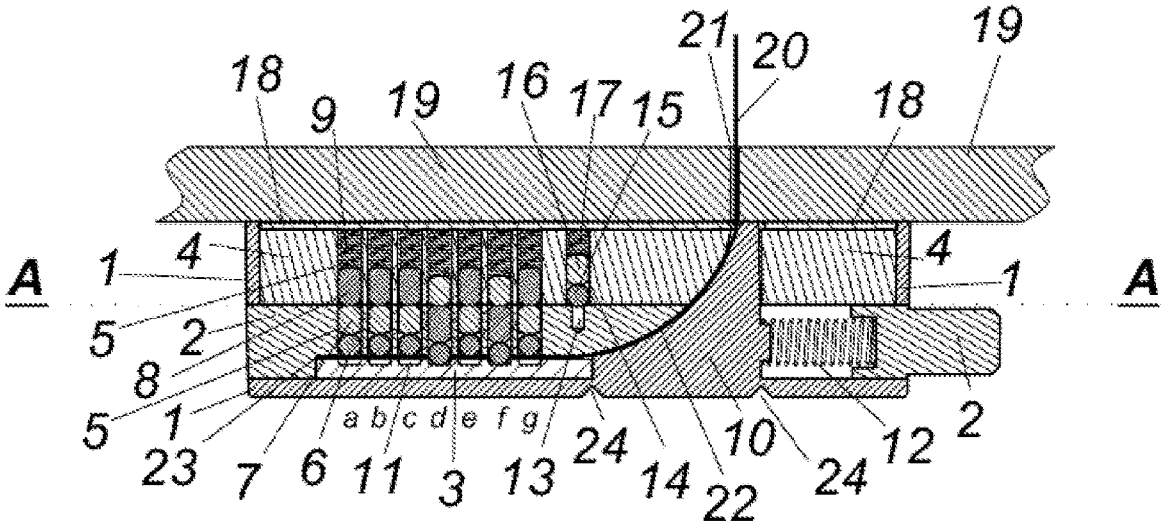
FIG. 3 shows the blocking lock in the locked state when the key is inserted with the correct code.

When inserting key 20 (FIG. 2) into the blocking lock through key slit 21 in door 19 (FIG. 3) and cover 18 of the blocking lock, key 20, while passing key slot 22, interacts with rotating protrusion 10 in housing 1, bends at an appropriate angle, which can lie in a wide range of angles, and is directed to the area of key mortise plate 3, which, in turn, has recess 11 for balls 6. In this case, balls 6, being in the positions of "a", "b", "c", "e" and "g", due to the lack of the openings in the corresponding points on key 20, arise from recesses 11 and lift corresponding short pins 7 up to the separation plane of locking plate 2 and matrix 4 (line A-A in FIGS. 1, 3, 4 and 6), and when in positions "d" and "f", due to the presence of the openings in key 20, balls 6 do not rise, leaving long pins 8 in the separation plane of locking plate 2 and matrix 4 (line A-A in FIGS. 1, 3, 4 and 6), thereby removing the interlock of locking plate 2 and matrix 4 and allowing the shift of locking plate 2 to the leftmost position in FIG. 4.

Figure 4:
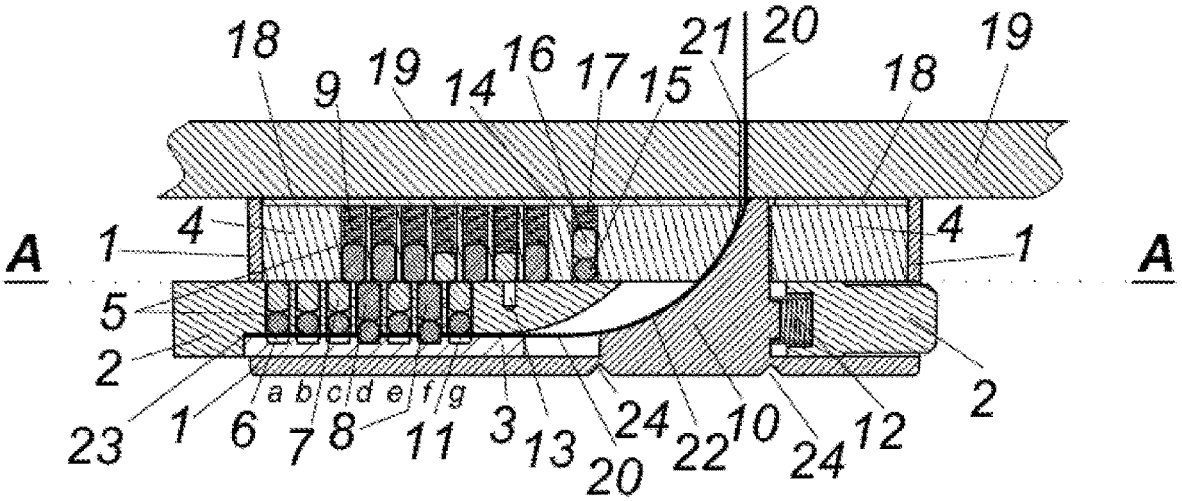
FIG. 4 shows the blocking lock with the key in the open state.

When inserting key 20 with the correct or incorrect code, there operates the synchronization system of the blocking lock. The synchronization system consists of openings 13 and 14 disposed in locking plate 2 and also matrix 4, fixing balls 15 of push pin (PIN) 16 and spring 17. Spring 17 pressure force significantly exceeds code springs 9 pressure force. Therefore, ball 15 will have been remaining in hole 13 for all the period of time when key 20 with the correct or incorrect code is entering the code control zone (positions "a" to "g" of key mortise plate 3) until key 20 has reached stop 23 in locking plate 2. If key 20 code is correct, corresponding short pins 7 will be delivered to the separation plane of locking plate 2 and matrix 4 (line A-A in FIGS. 1, 3, 4 and 6), and long pins 8 remain in the separation plane of locking plate 2 and matrix 4 (line A-A in FIGS. 1, 3, 4 and 6), thereby removing the mutual code blockage of locking plate 2 and matrix 4. When being further pressed, key 20 has been transferring the force to locking plate 2 through stop 23. Such a force is sufficient to lead ball 15 of the synchronization system from opening 13, as a result of which locking plate 2 is shifted under the action of key 20 in the extreme left "open" position, thus compressing working spring 12 and getting open the blocking lock. (FIG. 4).

To transfer the blocking lock to the locked position, it is enough to remove key 20 from the blocking lock. In this case, working spring 12 will shift locking plate 2 to the extreme right position in housing 1; when key mortise plate 3 rests against rotating protrusion 10 in housing 1, the ball of synchronization system 15 will sink into opening 13 under the action of spring 17 and pin 16 with synchronizing the axes of openings 5 in locking plate 2 and matrix 4. Upon further extracting key 20 from the blocking lock, it will occur into the locked state, being similar to the initial state shown in FIG. 1.

When trying to open the blocking lock with the help of key 20 (FIG. 5) of the wrong code (let it be code 0010000, that is, when the opening being in the position of "c" on key 20), the code mechanism of the blocking lock interacts with the key on short pin 7 being set in position "c" below the separation plane of locking plate 2 and matrix 4 (line A-A in FIGS. 1, 3, 4 and 6), and long pins 8 in positions "d" and "f" are occurred above the separation plane of locking plate 2 and matrix 4 (line A-A in FIGS. 1, 3, 4 and 6), thereby locking the movement of locking plate 2 when key 24 is pressed against stop 23. When doing so, the blocking lock remains in the locked state position.

Due to the fact that the thickness of key 20, which can pass through a narrow key slot 22 for a thin plate-like key, is very small, the blocking lock successfully stands up to destruction by force, remaining in a locked state even at attempt to break the locking code by force pressing key 20 into the blocking lock with an effort that can destroy the key itself. This is achieved by the fact that, due to the path of key 20 movement with bending, the force required to cut at least one pin 8 significantly exceeds the fracture force of thin key 20 without openings when this force is applied from door 19 outside. The blocking lock also successfully counteracts such a way of breakage as beating down the blocking lock from its fixture on door 19 through key slit 21. To counteract such a breakage, blocking lock housing 1 has groove 24 outside the perimeter of rotating protrusion 10, which weakens the housing in the area of the rotating protrusion. At any attempt to beat down the blocking lock through key slit 21, rotating protrusion 10 takes the impact force, tearing off along groove 24 and leaving housing 1 together with locking plate 2 in the locked state, which event protects the whole mechanism of the blocking lock from unlocking. Due to the fact that, as soon as rotating protrusion 10 has been torn off in housing 1, opposite the key slit, there are no lock elements which the breakage force can be applied to, the second attempt to break the blocking lock by beating down becomes impossible.

The invention claimed is:

1. A blocking lock with a matrix coding system comprising:

a housing containing a narrow slot for a plate-like key, a movable locking plate, a plurality of balls which overlap the slot for the plate-like key, and a plurality of ball openings, the plurality of ball openings located on a key mortise plate having a depth not greater than a radius of the plurality of balls, wherein the key mortise plate is rigidly fastened to the movable locking plate, and the housing contains a stationary matrix provided with code element openings, wherein the code element openings are drilled in the matrix coaxially with the locking plate in a maximum locked position, and provided with the ball openings, a short pin, a long pin, and a code spring disposed therein;

wherein in the housing, there is formed a rotating protrusion for guiding the key to an area of the key mortise plate having a recess for the balls;

wherein the housing comprises a working spring to interact with the housing and the locking plate;

wherein the locking plate and the matrix are provided with synchronization system openings designed for synchronizing operation of the blocking lock, which synchronization system also includes a locking ball, a push pin, and a spring of the synchronization system, the housing is closed with a cover to fix the matrix and compress the code springs and the synchronization system spring; and wherein the narrow slot has a curved shape formed by the radii of the rotating protrusion, the locking plate, and the matrix.

2. A blocking lock with a matrix coding system comprising:

a housing containing a narrow slot for a plate-like key, a movable locking plate, a plurality of balls which overlap the slot for the plate-like key, and a plurality of ball openings located on a key mortise plate, the plurality of ball openings having a depth not greater than a radius of the plurality of balls, wherein the key mortise plate is rigidly fastened to the movable locking plate, and the housing contains a stationary matrix provided with code element openings, wherein the code element openings are drilled in the matrix coaxially with the locking plate in a maximum locked position, and provided with the ball openings, a short pin, a long pin, and a code spring disposed therein;

wherein in the housing, there is formed a rotating protrusion for guiding the key to an area of the key mortise plate having a recess for the balls;

wherein the housing comprises a working spring to interact with the housing and the locking plate;

wherein the locking plate and the matrix are provided with synchronization system openings designed for synchronizing operation of the blocking lock, which synchronization system also includes a locking ball, a push pin, and a spring of the synchronization system, the housing is closed with a cover to fix the matrix and compress the code springs and the synchronization system spring; and wherein the plate-like key is thin and formed to be bent at an angle of up to 90 degrees from an initial direction of movement when inserted into the blocking lock.

3. The blocking lock with a matrix coding system according to claim 1, wherein a groove is formed in the housing of the blocking lock outside the perimeter of the rotating protrusion to loosen the housing in the area of the rotating protrusion.

* * * * *